US011351689B2

(12) United States Patent
Lucchese

(10) Patent No.: US 11,351,689 B2
(45) Date of Patent: Jun. 7, 2022

(54) RAZOR DEVICE

(71) Applicant: Neckrazor LLC, Hilton Head Island, SC (US)

(72) Inventor: Frank P. Lucchese, Hilton Head Island, SC (US)

( * ) Notice: Subject to any disclaimer, the term of this patent is extended or adjusted under 35 U.S.C. 154(b) by 24 days.

(21) Appl. No.: 16/528,978

(22) Filed: Aug. 1, 2019

(65) Prior Publication Data

US 2020/0290226 A1 Sep. 17, 2020

Related U.S. Application Data

(60) Provisional application No. 62/827,525, filed on Apr. 1, 2019, provisional application No. 62/818,146, filed on Mar. 14, 2019.

(51) Int. Cl.
*B26B 21/52* (2006.01)
*B26B 21/10* (2006.01)
*B26B 21/40* (2006.01)

(52) U.S. Cl.
CPC ..... *B26B 21/525* (2013.01); *B26B 21/10* (2013.01); *B26B 21/4056* (2013.01); *B26B 21/52* (2013.01); *B26B 21/521* (2013.01); *B26B 21/522* (2013.01); *B26B 21/527* (2013.01)

(58) Field of Classification Search
CPC ..... B26B 21/10; B26B 21/525; B26B 21/52; B26B 21/521; B26B 21/527
USPC ..... 30/34.05, 34.1, 47–53, 526, 527; D28/46–48
See application file for complete search history.

(56) References Cited

U.S. PATENT DOCUMENTS 2,587,336 A * 2/1952 Larson ..... A01D 1/04 30/299
2,587,964 A * 3/1952 Burns ..... B26B 21/4006 30/50
2,991,553 A * 7/1961 Levine ..... B26B 21/00 30/30
4,501,066 A * 2/1985 Sceberras ..... B26B 21/52 30/47
4,791,724 A * 12/1988 Dumas ..... B26B 21/18 30/48
5,426,853 A * 6/1995 McNinch ..... B26B 21/14 30/48
6,125,857 A * 10/2000 Silber ..... B26B 21/523 30/34.1
6,308,416 B1 * 10/2001 Bosy ..... B26B 21/52 30/50
6,434,828 B1 * 8/2002 Andrews ..... B26B 21/56 30/50
6,493,950 B1 * 12/2002 Kludjian ..... B26B 21/527 30/50
6,497,043 B1 12/2002 Jacobsen
6,550,148 B2 * 4/2003 Cecil ..... B26B 21/527 30/50

(Continued)

*Primary Examiner* — Jason Daniel Prone

(57) ABSTRACT

A shaving device that shaves behind the neck and other hard to reach areas of the body. Two or more blade mounting assemblies can be attached to each other with living hinges end to end along a longitudinal axis, with two handles situated at either end of the set of blade mounting assemblies along the same axis. The blade mounting assemblies are configured to receive replaceable blade cartridges. When mounted in the blade mounting assemblies, the blade cartridges can pivot on an axis parallel to the longitudinal axis of the set of assemblies.

4 Claims, 12 Drawing Sheets

(56) References Cited

U.S. PATENT DOCUMENTS

| | | | | |
|---|---|---|---|---|
| 6,634,104 | B2 | 10/2003 | Jacobsen | |
| 7,322,108 | B2 * | 1/2008 | Caldwell | B26B 21/00 30/49 |
| D659,904 | S * | 5/2012 | Gilbert | D28/48 |
| 8,533,959 | B2 * | 9/2013 | Davis | B26B 21/4043 30/34.1 |
| 8,707,561 | B1 * | 4/2014 | Kneier | B26B 21/52 30/50 |
| 8,739,411 | B2 * | 6/2014 | Kinghorn | B26B 21/42 30/526 |
| 8,744,192 | B2 | 6/2014 | Ortins et al. | |
| 9,289,908 | B2 * | 3/2016 | Marder | B26B 21/52 |
| 9,950,434 | B2 | 4/2018 | Binder | |
| D890,428 | S * | 7/2020 | Simkovitz | D28/46 |
| 11,104,021 | B1 | 8/2021 | Simkovitz | |
| 2004/0098862 | A1 | 5/2004 | Orloff | |
| 2008/0172882 | A1 * | 7/2008 | Eger | B26B 21/52 30/49 |
| 2011/0252538 | A1 | 10/2011 | Tucker et al. | |
| 2012/0227554 | A1 | 9/2012 | Beech | |
| 2013/0152400 | A1 * | 6/2013 | Nunez | B26B 21/523 30/47 |
| 2014/0130642 | A1 | 5/2014 | Rodriguez | |
| 2014/0259679 | A1 * | 9/2014 | Tracy | B26B 21/521 30/50 |
| 2015/0183119 | A1 * | 7/2015 | Contaldi | B26B 21/527 30/50 |
| 2016/0001454 | A1 * | 1/2016 | Coresh | B26B 21/225 30/50 |
| 2016/0193740 | A1 * | 7/2016 | Phillips | B26B 21/527 30/34.05 |
| 2017/0136638 | A1 * | 5/2017 | Hage | B26B 21/525 |
| 2018/0085953 | A1 | 3/2018 | Lopez et al. | |
| 2018/0207823 | A1 | 7/2018 | Neyer et al. | |
| 2018/0354147 | A1 | 12/2018 | Goldfarb et al. | |

* cited by examiner

RAZOR DEVICE

PRIORITY CLAIM

This is a non-provisional patent application, that claims the benefit of U.S. Prov. Pat. App. No. 62/827,525 filed on Apr. 1, 2019 and U.S. Prov. Pat. App. No. 62/818,146, filed on Mar. 14, 2019, both of which are hereby incorporated by reference in their entireties for all that they incorporate therein.

FIELD AND BACKGROUND OF INVENTION

The invention is a shaving device that can be operated by a user to make it possible for the user to reliably and easily shave behind the neck and other hard to reach areas of the user's body.

BRIEF DESCRIPTION OF THE DRAWINGS

The headings provided herein are for convenience only and do not necessarily affect the scope or meaning of the claimed invention. In the drawings, the same reference numbers and any acronyms identify elements or acts with the same or similar structure or functionality for ease of understanding and convenience. To easily identify the discussion of any particular element or act, the most significant digit or digits in a reference number refer to the Figure number in which that element is first introduced.

DETAILED DESCRIPTION OF THE PREFERRED EMBODIMENTS

Figure 1:
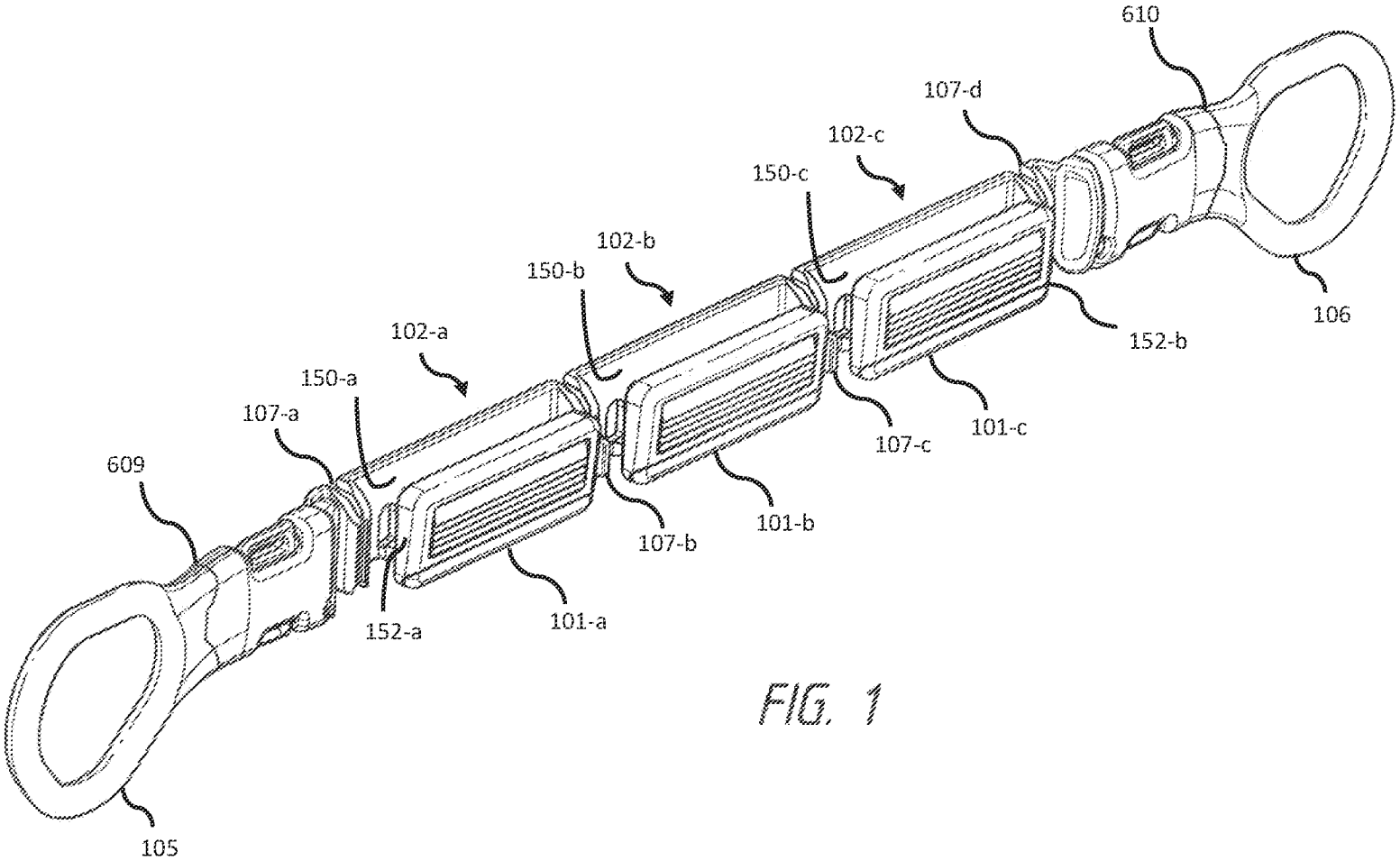
FIG. 1: Shows an exemplary configuration of the shaving device from the blade-side perspective.

The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

The invention is a device that is comprised of at least one blade mounting assembly, for example blade mounting assembly 102-*a*, where a plurality of blade mounting assembly backs 150-*a*, 150-*b* and 150-*c* are attached to each other along their longitudinal axis by means of a hinges, for example hinges 107-*b* and 107-*c*, or flexible material. In use, at least one shaving blade cartridges, for example cartridges 101-*a*, 101-*b* and 101-*c* are attached by a corresponding at least one mechanical attachment mechanism, for example attachment mechanism 601-*a* shown in FIG. 6, to the corresponding blade mounting assemblies, for example blade mounting assemblies 102-*a*. 102-*b* and 102-*c*. The outer two blade mounting assemblies 102-*a* and 102-*c* are further attached along the device's longitudinal axis to two corresponding handles 105 and 106 with two more flexible hinges 107-*a* and 107-*d*, respectively, that may also be twistable. In use, the device is shaped in a curve, or "U"-like shape, with the face of the blade edges on the inside of the "U", that is, the hinges flex inward in a direction perpendicular to the plane of the blade mounting assemblies. The device hinges 107-*a*, 107-*b*, 107-*c* and 107-*d* may be flexible to allow the shape of the device to vary by how the device is held and the shape of the surface being shaved. The blade mounting assemblies 102-*a*, 102-*b* and 102-*c* are oriented so that the at least one blade cartridges are operably facing the interior of the curve shape formed by the device when in use. The person operating the device can situate the device around the back of their own neck while facing a mirror, yet hold the device using the two handles 105 and 106 on either side of their neck. In the preferred embodiment, the distance from the centers 609 and 610 of the handles 105 and 106, respectively, to the edges 152-*a* and 152-*b*, respectively, of the blade cartridges 101-*a* and 101-*c*, respectively, is sufficiently long that the ends of the handles, in use, extend in front of the ear area of the person using the device. In one embodiment, the distance from the center of the handles 609 and 610 to the respective hinges 107-*a* and 107-*b*, respectively, attaching the neighboring blade mounting assemblies 102-*a* and 102-*c*, respectively, is between and including 2 to 7 inches. In another embodiment, that distance is approximately 5 inches. In one embodiment, the handles 105 and 106 have finger holes in the center. Using a stroking motion perpendicular to the longitudinal axis of the device, the hair on the back of the user's neck area can be shaved by the user.

Figure 2:
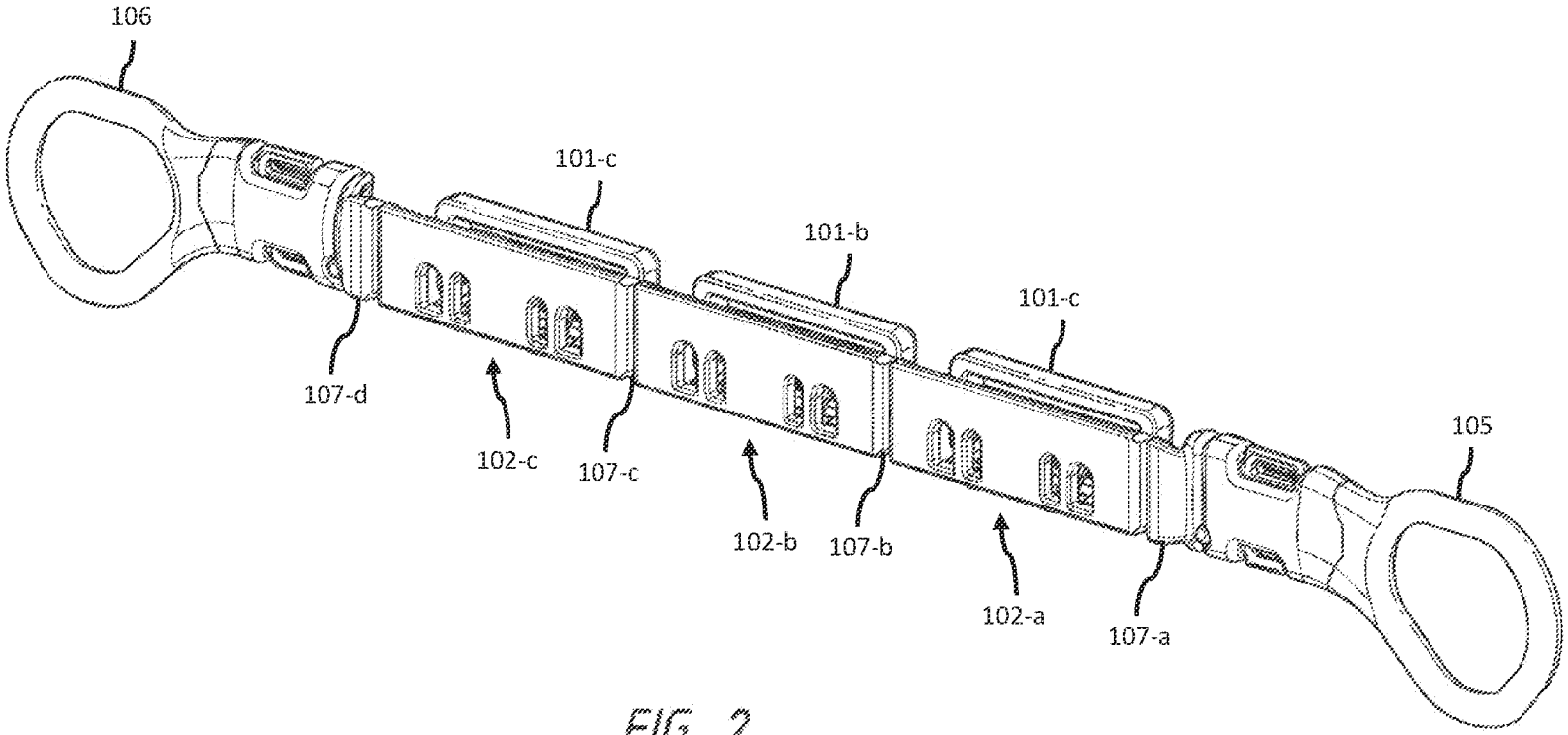
FIG. 2: Shows the exemplary configuration of the shaving device from the back-side perspective.
Figure 3:
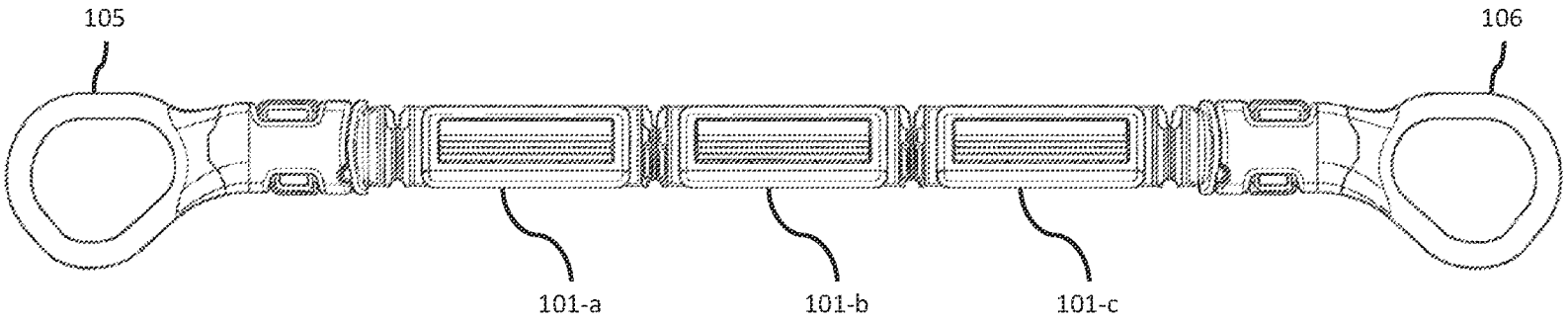
FIG. 3: Shows the exemplary configuration of the shaving device from the blade-side with a front face perspective.
Figure 6:
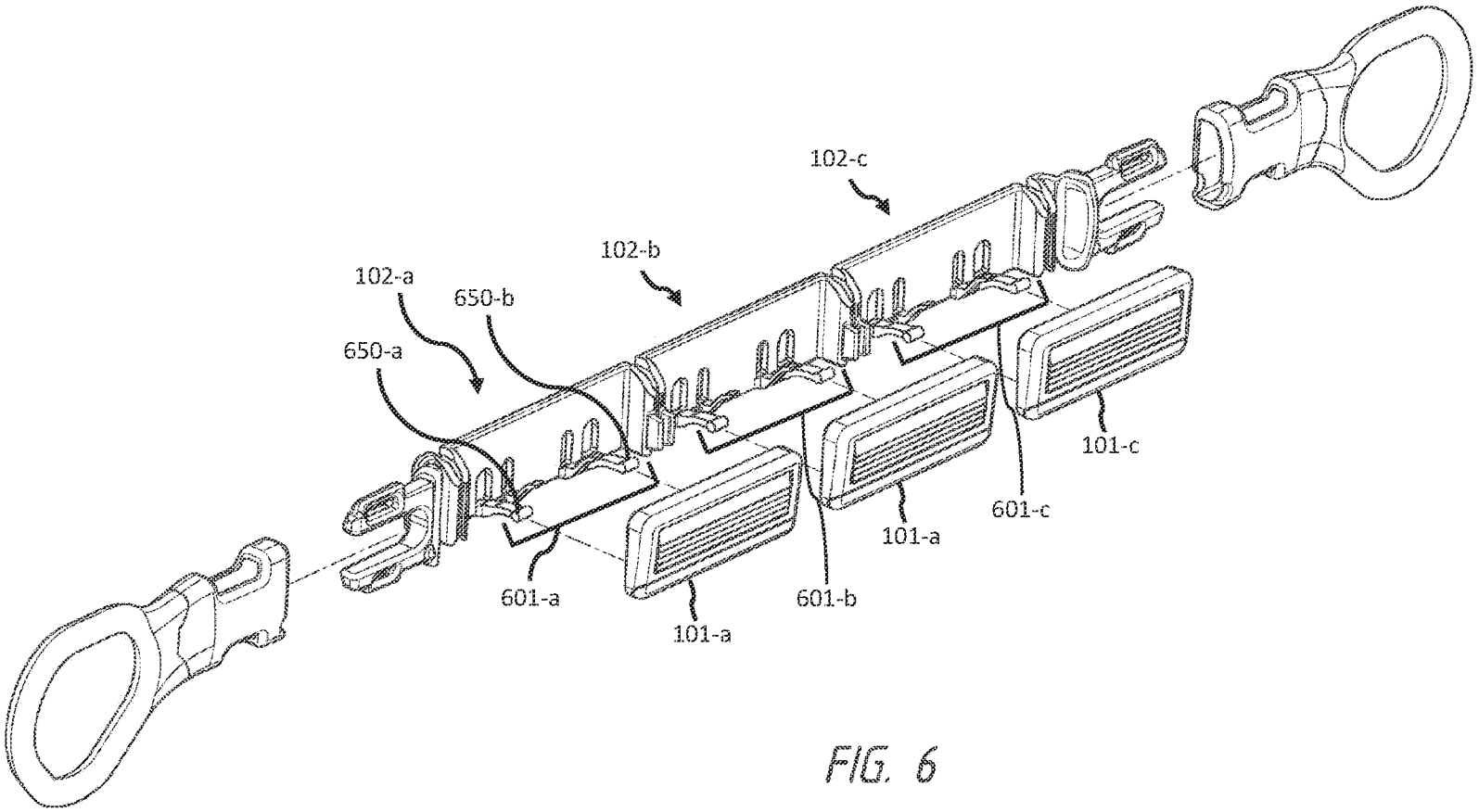
FIG. 6: Shows the exemplary configuration of the shaving device from the blade-side perspective, showing the blade cartridges detached from the blade mounting assembly back.
Figure 7:
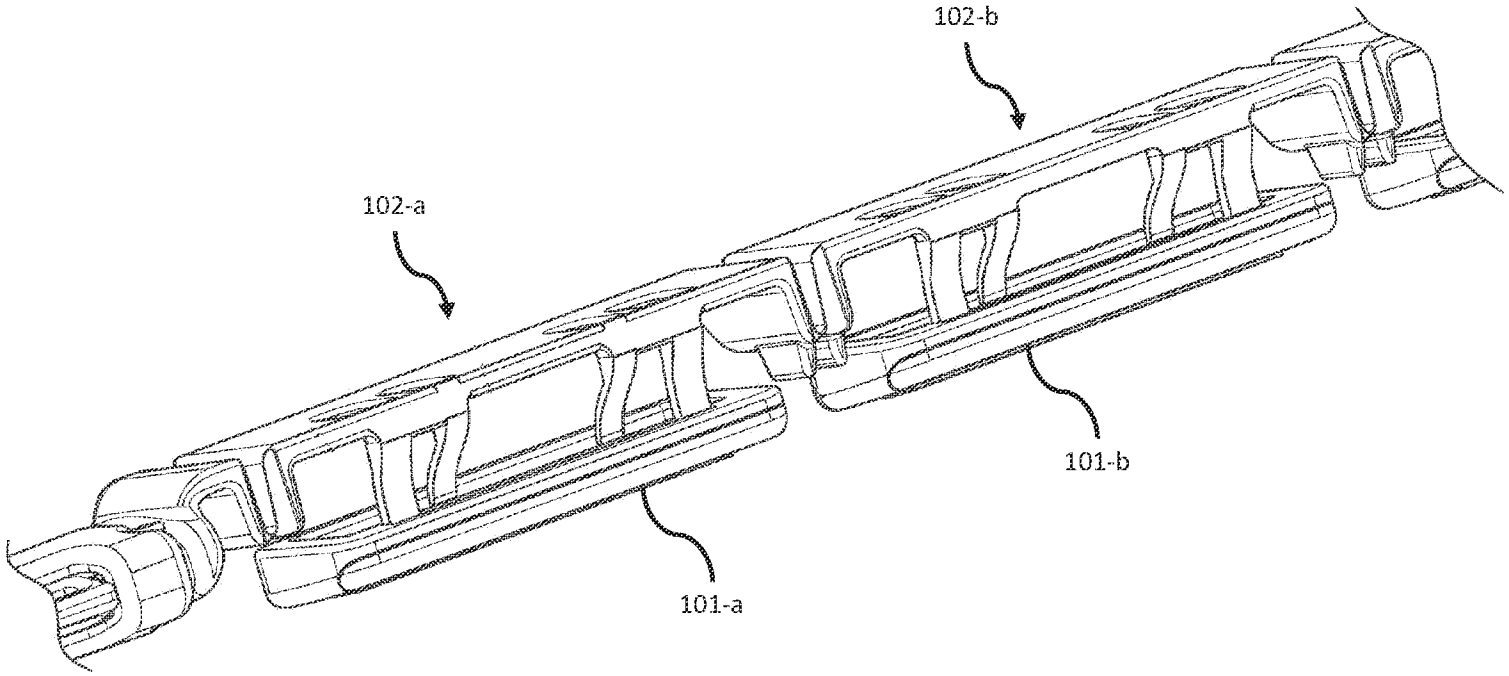
FIG. 7: Shows the exemplary configuration of the shaving device from the top view perspective, with a close up of the blade cartridges attached by the blade mounting assembly mechanism to the device back.

Referring now to FIG. 2, in a further embodiment, as depicted in the figures, the device is comprised of blade mounting assemblies 102-*a*. 102-*b* and 102-*c* connected by living hinges 107-*b* and 107-*c*, that provide bend flex and optionally, with torsion flex. In this embodiment, the device is comprised of at least one blade mounting assembly component, for example blade mounting assembly 102-*a*. The blade mounting assemblies 102-*a*, 102-*b* and 102-*c* are comprised of attachment mechanisms 601-*a*, 601-*b* and 601-*c* respectively as shown in FIG. 6, that permit the blade cartridges 101-*a*, 101-*b* and 101-*c* to be mechanically attached to the assembly in such a way that that cartridge can be removed and replaced with a fresh blade cartridge. On either end of the set of blade mounting assemblies, ergonomic reusable pull handles 105 and 106 are attached. In one embodiment, each blade cartridge 101-*a*, 101-*b* and 101-*c* can be replaced individually on its corresponding blade mounting assembly, 102-*a*, 102-*b* and 102-*c*, respectively. As depicted in FIG. 6, each blade cartridge 101-*a*, 101-*b* and 101-*c* may be replaced on its own. In the preferred embodiment, the blade cartridges 101-*a*, 101-*b* and 101-*c* are connected to the blade mounting assemblies 102-*a*, 102-*b* and 102-*c*, respectively, via a snap-on pin receiver, for example, snap-on pin receivers 650-*a* and 650-*b*, mounted on the blade mounting assembly, for example blade mounting assembly 102-*a*, that is configured to permit pivoting rotation by the mounted blade cartridge 101-*a*. In one embodiment the dimensions of the face of the blade cartridge 101-*a* may be approximately 0.85 inches by approximately 1.17 inches.

Figure 5:
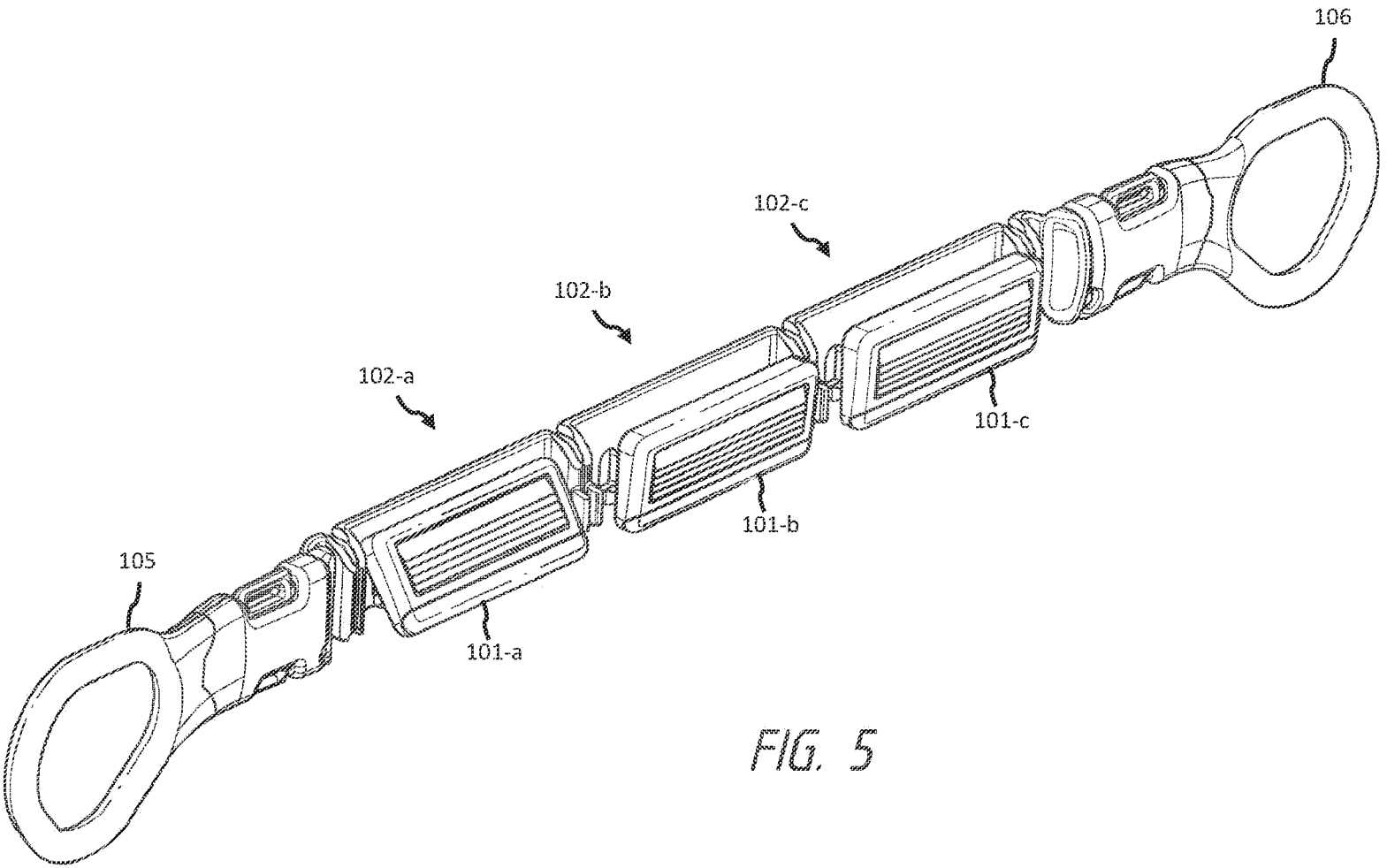
FIG. 5: Shows the exemplary configuration of the shaving device from the blade-side perspective, with one blade cartridge having the normal axis of its surface at a displaced angle from the normal horizontal plane of the device.
Figure 8:
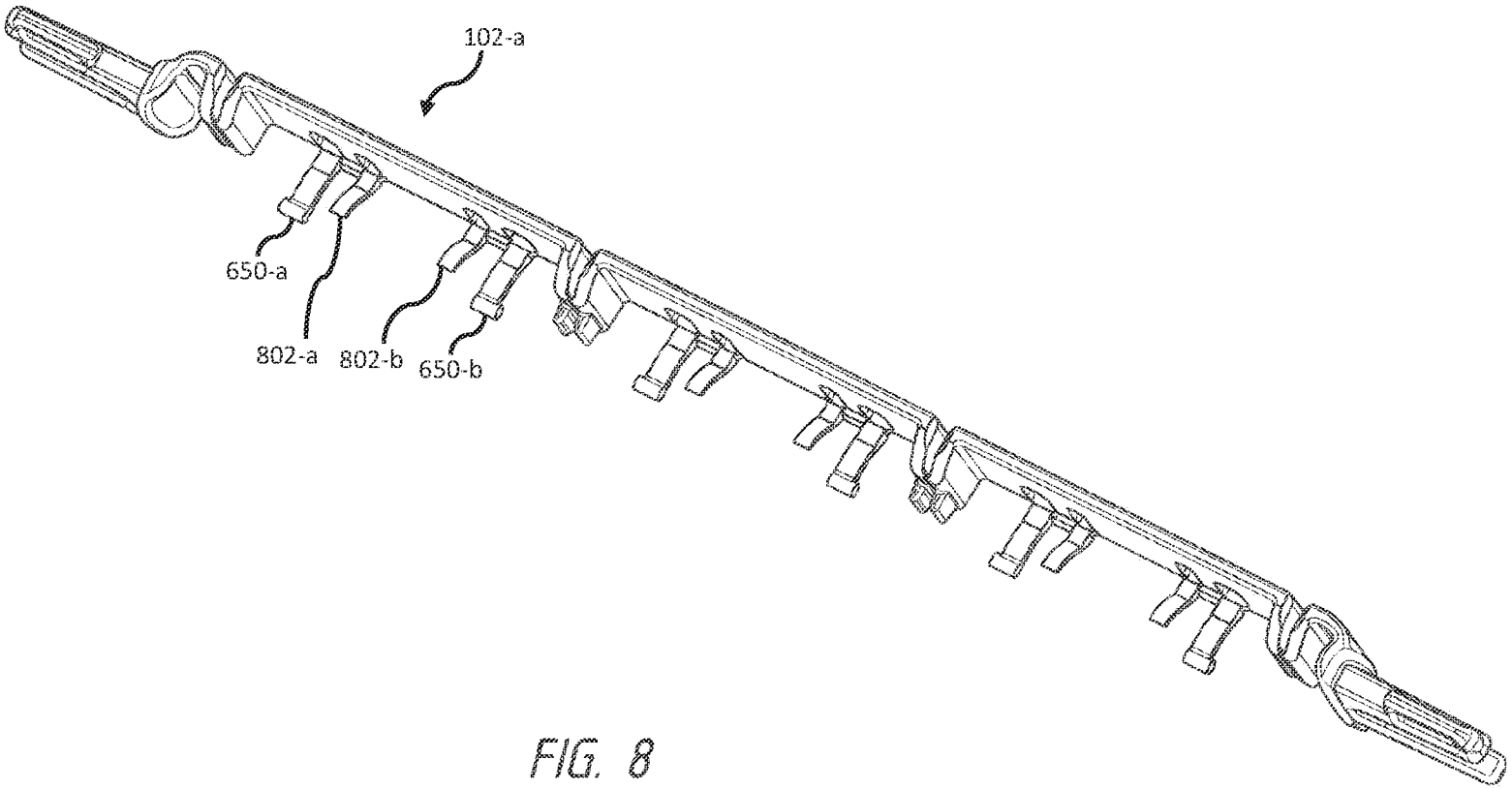
FIG. 8: Shows the exemplary configuration of the shaving device from the top view perspective, with a close up of the blade mounting assembly backs with the blade cartridge attachment mechanisms.
Figure 12:
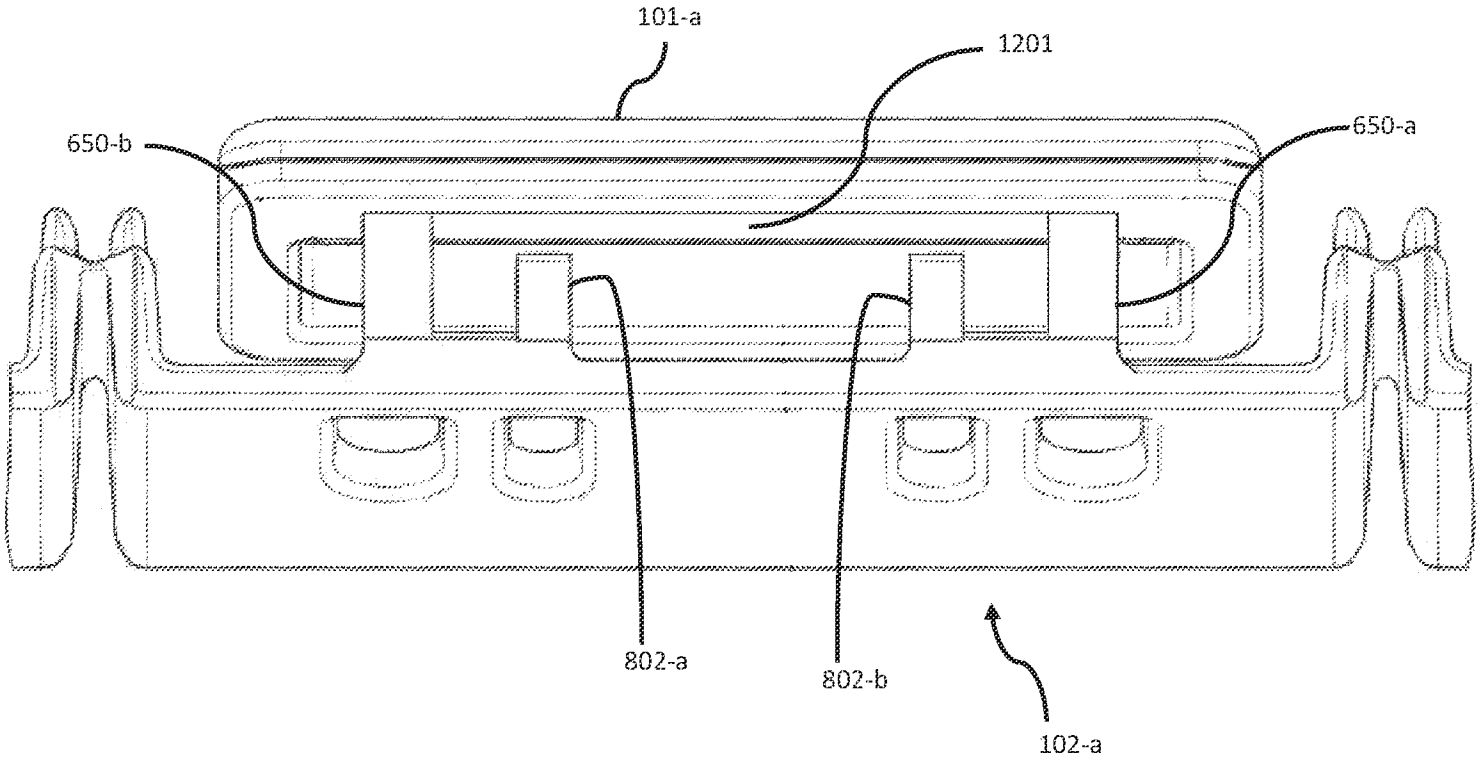
FIG. 12: Shows a close up of the blade mounting assembly from the back with the blade cartridge mounted on it using the attachment mechanism.

In one embodiment, the snap-on pin receivers, for example snap-on pin receiver 650-*a*, attached to the blade mounting assembly, for example blade mounting assembly 102-*a*, may be used to attach the blade cartridge, for example blade cartridge 101-*a*, to the blade mounting assembly. In a preferred embodiment, the snap-on pin receivers, for example snap-on pin receivers 650-*a* and 650-*b* are integral to the material forming the blade mounting assembly 102-*a*. Referring now to FIG. 8, in the preferred embodiment, snap-on pin receivers 650-*a* and 650-*b* and stabilizing pins 802-*a* and 802-*b* are arranged as two rows of two pins. Two pins on one row are the snap-on pin receivers 650-*a* and 650-*b*. They have notches or hook shapes to them to hold the blade cartridge 101-*a* in place. The other row of two stabilizing pins 802-*a* and 802-*b* stabilize the blade cartridge 101-*a*. The snap-on pin receivers 650-*a* and 650-*b* are hooked or otherwise have a snap mechanism and act as a rotation pin. The rotation pin size and height spacing geometries (which provide pin-arm flex features) provide the blade cartridge 101-*a* the ability to pivot around the axis defined by the ends of the two snap-on pin receivers 650-*a* and 650-*b*, which in the preferred embodiment is parallel the longitudinal axis of the blade mounting assembly, for example blade mounting assembly 102-*a*. The stabilizing pins 802-*a* and 802-*b* set the range of the pivot in one direct, while the hook or attachment mechanism on the snap-on pin receivers 650-*a* and 650-*b* defines the range of the pivot in the other. Referring briefly to FIG. 12, in this embodiment, the blade cartridge 101-*a* has cartridge slot 1201 on the opposite side from the face of the blade edges. The cartridge slot 1201 may have a height between 0.25 and 0.325 inches in order to achieve the snap function when replacing the razor cartridge, which is done through a push-concept pushing onto the two snap-on pin receivers 650-*a* and 650-*b* that snap into the housing of the cartridge. In the preferred embodiment, the distance between the outside of snap-on pin receivers 650-*a* and 650-*b* on the same blade mounting assembly 102-*a* is between about 1.25 inch and 1.75 inches. Referring now to FIG. 5, in one embodiment, the blade mounting assemblies, for example blade mounting assembly 102-*a*, permit the blade cartridge, for example blade cartridge 101-*a*, to pivot, or rock back and forth vertically, that is, around an axis substantially parallel to the longitudinal axis of the device, but do not permit any appreciable rotational motion that would create a blade cutting edge that is not substantially parallel to the longitudinal axis of the device itself. This motion is separate for each blade cartridge, for example blade cartridges 101-*a*, 101-*b* and 101-*c*. For example, the angular position of the blade cartridge 10*l*-*a* is different from that of blade cartridge 101-*b*. In one embodiment, the range of the pivot angle of the blade cartridges, when mounted is less than or about plus or minus 10 degrees from the nominal position, where nominal is when the plane of the blade edges is parallel to the plane of the blade mounting assembly.

Figure 4:
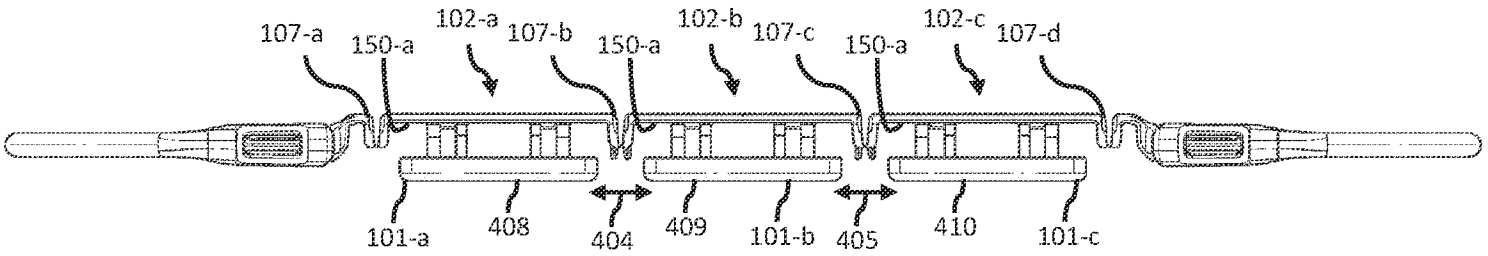
FIG. 4: Shows the exemplary configuration of the shaving device from the top-view perspective.

In another embodiment, as depicted in FIG. 4, each blade mounting assembly 102-*a*, 102-*b* and 102-*c* in use has a corresponding blade cartridge 101-*a*, 101-*b* and 101-*c*, respectively, attached to it that may be 1.17 inches wide. In one embodiment, the face of the blades 408, 409 and 410 are situated so that the face of blades 408, 409 and 410 are at a height of about 0.625 inches off of the interior surface of blade mounting assembly backs 150-*a*, 150-*b* and 150-*c* of the respective blade mounting assemblies 102-*a*. 102-*b* and 102-*c*. The spacing 404 and 405 between neighboring blade cartridges when mounted on the mounting assemblies must be sufficiently wide to permit flexibility in the device as it conforms to the dimensions of the surface that is being shaved. As the device flexes inward, the neighboring blade cartridges will move toward each other to the point that they may touch, and limit any further inward flex. If the cartridges are too close, the tightest curve that the device can shave may be too large, or cartridges may pop off the device. If the gap between the blade cartridges is too large, then the device requires more shaving action so that the user doesn't miss shaving parts of the surface. Preferably, each of the blade mounting assemblies, for example blade mounting assemblies 102-*a*, 102-*b* and 102-*c* are dimensioned in length along the longitudinal axis of the device so that the spacing 404 and 405 between the neighboring ends of neighboring blade cartridges when mounted on the blade mounting assemblies is between about ¼ inch and 9/16 th of an inch, and preferably about ⅜ of an inch or in some embodiments, half an inch. In one embodiment, the length of the blade mounting assemblies is such that the distance between their interior hinges, for example hinges 107-*b* and 107-*c* and is between and including about ½ inch and about 1 inch, and preferably about ¾ of an inch or in some embodiments, half an inch.

Figure 11:
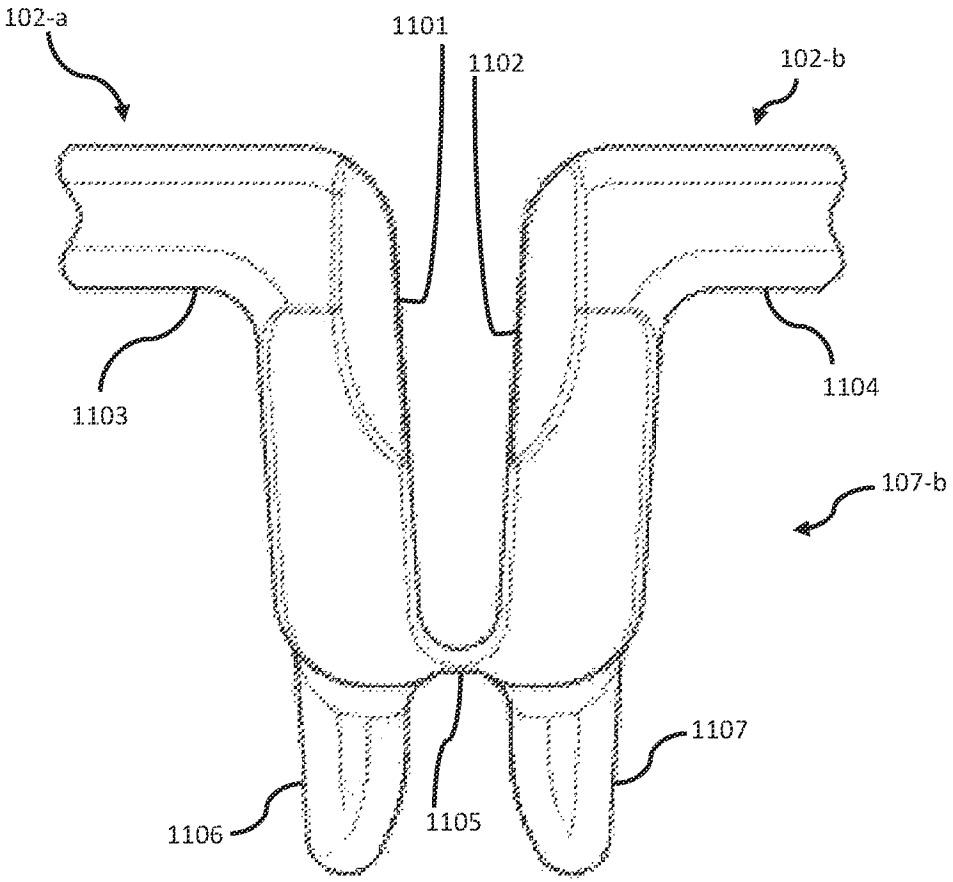
FIG. 11: Shows a close up of the hinge are between two blade mounting assemblies.

Referring now to FIG. 11, living hinges, for example hinge 107-*b*, or flexible material, connect each of the blade assemblies 102-*a*, 102-*b* and 102-*c* to each other or the handles 105 and 106 such that in the preferred embodiment, the range of flexibility of the hinge is less than or about plus or minus 30 degrees from the nominal along the longitudinal axis of the device. As shown in the top view of FIG. 11, the hinge sides 1101 and 1102 form a sharp angle extending away from planes 1103 and 1104 of the surface of the blade mounting assemblies 102-*a* and 102-*b* that come to a connection point 1105 that is comprised of a thin, flexible material that connects between the two neighboring hinge sides 1101 and 1102 of the neighboring blade mounting assemblies 102-*a* and 102-*b*. The thin, flexible material between the two blade mounting assemblies 102-*a* and 102-*b* at the connection point 1105 acts as the hinge. The angle of the hinge sides 1101 and 1102 extending away from planes 1103 and 1104 of the surface of the blade mounting assemblies 102-*a* and 102-*b* to the connection point 1105 prevents the user from over-stressing the connection point 1105 when flexing outward, away from the blade side of the device, because the two hinge sides 1101 and 1102 will meet at the furthest permitted extent of that motion. Similarly, the sides of the hinge have protrusions 1106 and 1107 extending past the connection point 1105 forming the hinge that act as stop points in the other direction. If the device is flexed too far inward, toward the blade side of the device, the protrusions 1106 and 1107 will meet and stop the motion, thereby alleviating stress on the hinge connection point in that direction.

Figure 9:
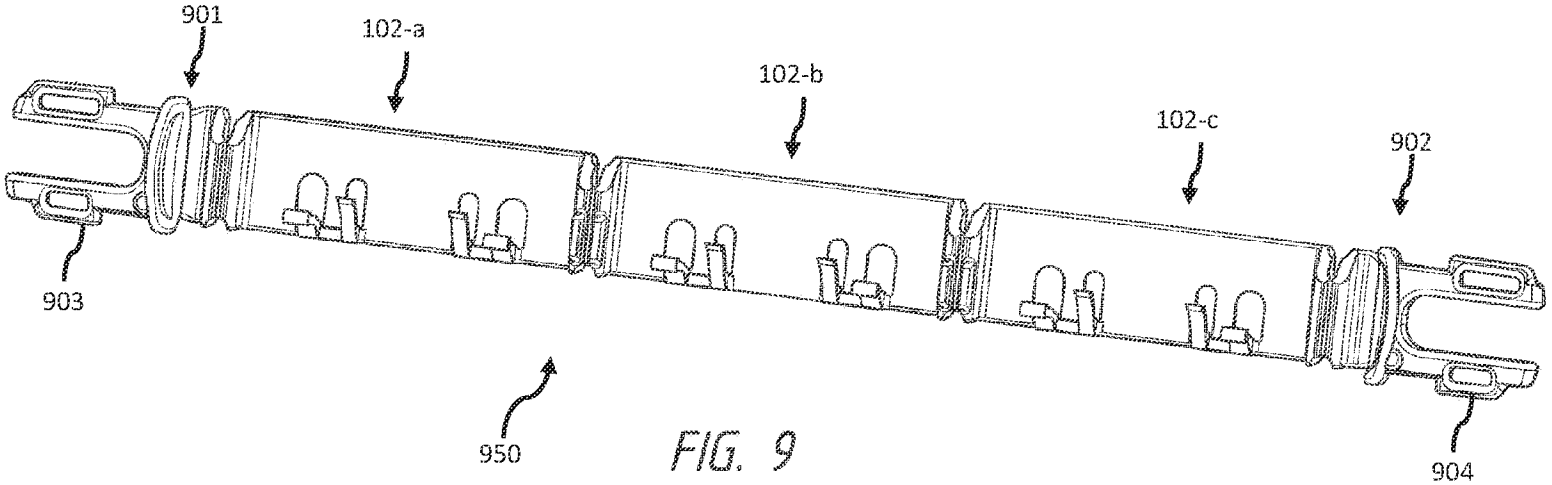
FIG. 9: Shows the exemplary configuration of the shaving device from the side view perspective, with a close up of the blade mounting assembly backs with the blade cartridge attachment mechanisms.
Figure 10:
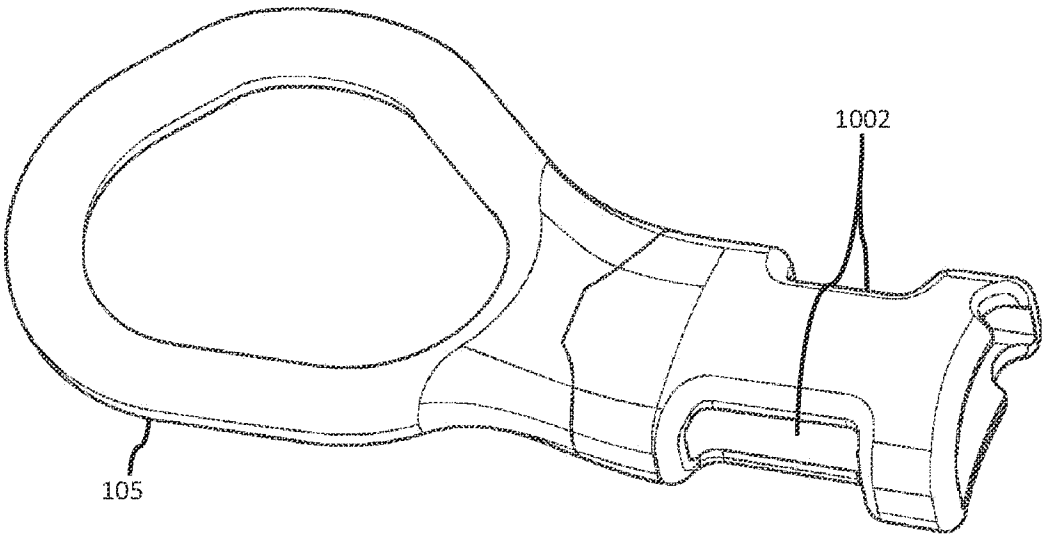
FIG. 10: Shows an exemplary configuration of the handle of the shaving device.

In another embodiment, as depicted in FIG. 9, the set 950 of blade mounting assemblies 102-*a*, 102-*b* and 102-*c* may be disposable. At either end 901 and 902 of the set 950 of blade mounting assemblies 102-*a*, 102-*b* and 102-*c*, the outer two assemblies have clips 903 and 904 to attach handles 105 and 106. In one embodiment, the male side of the clips 903 and 904 can slide into and snap into the respective female side which forms a portion of each of handles 105 and 106. Referring to FIG. 10, in this embodiment, the two reusable comfort ring grip handles 105 and 106 (handle 105 shown for illustration purposes in FIG. 10) are comprised of female snap mechanisms (female snap mechanism 1002 shown for illustration purposes in FIG. 10), into which the male clip portion, for example clip 903 or 904, of either end 901 or 902 of the blade mounting assembly set 950 can attach. The clips 903 and 904 of ends 901 and 902 may be equipped with quick release button latches. In this embodiment, the entire set 950 of blade mounting assemblies can be replaced by applying pressure to the quick release button latches. Then, set 950 may be replaced by snapping the handles 105 and 106 onto both ends of a new set. In alternative embodiments, the entire set is comprised of at least three razor blade cartridges. In this embodiment, the grip handle length may be increased and the area in between the handles and the blade mounting assembly component is round, a single piece of material and comprised of materials to provide for twist or torque around the longitudinal axis of the device. Further, in this embodiment the razor blade cartridges are positioned as close to each other as possible.

In yet another embodiment, the invention may be configured in a more disposable format. In this embodiment, the two handles are connected by one flexible member between them. The flexible member may be comprised of rubber or a flexible plastic. In this embodiment, the invention is comprised of razor blades that are integrated into the flexible member directly. In one version of this embodiment, the blades are partially embedded into the material forming the member with spacing between the blades along the longitudinal axis as described above. In another embodiment, the device is comprised of blade cartridges that are attached to the flexible member using an adhesive or by embedding the blade cartridges into the material comprising the flexible member. The gap spacing between the edges of neighboring blade cartridges is as described above. In this version of the invention, the material forming the single flexible member act as the hinges between the blades or cartridges that are embedded or attached to the member. In addition, the handles may be formed as part of the flexible member in one piece.

In yet another embodiment, the device can be further comprised of a sensor that detects the orientation of the device relative to the force of gravity. In the preferred embodiment, the orientation sensor is situated to effectively measure the angle from the longitudinal axis of the device to the direction of gravity. In order that the shaving action produce what would be viewed as a proper cut at the bottom of the back of the scalp of the user, this angle should ideally be 90 degrees, so that the cut line is effectively a horizontal line segment. In this embodiment, the sensor information can feed a microcontroller that determines using program or electronic logic when the device is substantially in a horizontal position. The device handles ends can be further comprised of light emitting devices, typically LEDs, that are operatively connected to the microcontroller and the logic programmed or wired to illuminate the lights when the substantially horizontal position is achieved. In this embodiment, the LEDs may be embedded in the handle assemblies on the blade-side of the device so that they may be viewed by the user while the user uses the device while looking in a mirror. The microcontroller can be any small microprocessor that continuously runs a sensing operation, or a hard-wired logic circuit that performs the same function. In yet another embodiment, the microcontroller is an analog circuit that responds to an analog output of the orientation sensor to control the lights. The microcontroller may be connected through its data input pins to the orientation sensor that detects the direction of gravity. By placing the orientation sensor in the device at a known, predetermined orientation relative to the longitudinal axis of the device, the sensor output effectively delivers to the microcontroller the relative angle of that axis in relation to the direction of gravity, that is, the down direction. The microcontroller can poll the sensor and read the data value constituting the orientation angle of the sensor/device to the down direction. When that value is detected to be within a pre-determined tolerance range, the logic in the program can cause the microcontroller to then activate a "green" LED light that is connected to another output pin on the microcontroller. When that value is detected to be outside that tolerance range, the logic can cause the microcontroller to activate a "red" LED or no LED. The selection between the two outcomes is accomplished with a branching statement in the program that is within the program loop. After activating or deactivating the appropriate LED, the program can return to the top of the loop to fetch the orientation value again and test it with the branching statements again.

What is claimed:

1. A razor device comprising:

a first blade mounting assembly having a first assembly first end and a first assembly second end;

a second blade mounting assembly having a second assembly first end and a second assembly second end;

wherein the first blade mounting assembly and the second blade mounting assembly are disposed adjacent one another, wherein the first blade assembly is joined at the first assembly second end to the second assembly first end by a hinge; and wherein a first handle is joined to the first assembly first end.

2. The razor device of claim 1, wherein the first blade mounting assembly and the second blade mounting assembly share a longitudinal axis, and wherein the hinge is configured to flex in a first direction perpendicular to the longitudinal axis and also in a second direction opposite the first direction.

3. The razor device of claim 2, wherein the hinge comprises a first protrusion and a second protrusion which meet when the hinge is flexed in the first direction so as to limit the flexion of the hinge in the first direction, and wherein the hinge comprises a first side and a second side which meet when the hinge is flexed in the second direction so as to limit the flexion of the hinge in the second direction.

4. The razor device of claim 1, further comprising a first removable blade cartridge and a second removable blade cartridge, wherein the first blade assembly is configured to receive the first removable blade cartridge and the second blade assembly is configured to receive the second removable blade cartridge.

* * * * *